United States Patent [19]

Lomax

[11] 4,267,979

[45] May 19, 1981

[54] DUAL-PHASE ATOMIZER

[75] Inventor: George F. Lomax, Tyler, Tex.

[73] Assignee: Howe-Baker Engineers, Inc., Tyler, Tex.

[21] Appl. No.: 95,301

[22] Filed: Nov. 19, 1979

[51] Int. Cl.[3] ..... B05B 7/08; F23D 11/40

[52] U.S. Cl. ..... 239/419; 239/426

[58] Field of Search ..... 239/405, 419, 419.3, 239/422, 424–425, 426, 427.3, 427.5, 428, 431, 432, 434

[56] References Cited

U.S. PATENT DOCUMENTS

| | | | |
|---|---|---|---|
| 1,516,408 | 11/1924 | Schumann | 239/431 |
| 1,565,996 | 12/1925 | French | 239/419 |
| 2,392,386 | 1/1946 | Jenkins | 239/419 |
| 3,790,086 | 2/1974 | Masai | 239/426 X |

*Primary Examiner*—Andres Kashnikow

*Attorney, Agent, or Firm*—Dennison, Meserole, Pollack & Scheiner

[57] ABSTRACT

The invention comprises an atomizing device capable of efficient conversion of liquids to a gaseous state by subjection in a primary atomization zone of a liquid to a first high velocity flow of an atomizing medium in order to impart substantial aerodynamic shear to the liquid, a mixture of finely dispersed atomizing medium and liquid being thus formed. The mixture is then subjected in a secondary atomization zone to a second high velocity flow of an atomizing medium downstream of the first atomization zone. The present structure is particularly useful in fuel burner applications, especially high fuel flow and high heat applications where rapid emulsification and dispersion of fuel is necessary to promote rapid and complete combustion. Fuel materials previous considered difficult to burn can be combusted readily through use of the present structure.

7 Claims, 4 Drawing Figures

DUAL-PHASE ATOMIZER

BACKGROUND OF THE INVENTION

1. Field of the Invention

The invention relates to atomizing apparatus wherein a liquid is dispersed into a fine mist by an atomizing medium, the invention being particularly useful for increasing combustion efficiency of a liquid fuel or the like. The present invention more expressly relates to an aerodynamic atomizer structure wherein a first flow of atomizing medium moving at sonic velocities imparts maximum aerodynamic shear to a liquid in a first atomization zone and wherein a second flow of atomizing medium downstream of the first atomization zone is directed against the mixture of atomizing medium and liquid to disperse and redirect the emulsified liquid.

2. Description of the Prior Art

Practical considerations made even more compelling by the need to conserve dwindling fossil fuel energy resources require that presently used fuels be burned as efficiently as possible. Since the fuels which are primarily used for burning in home and industrial furnaces are becoming increasingly scarce, it is also necessary that fuel sources be developed and utilized which have not previously been capable of being efficiently burned with available burners. Materials such as asphalt and the like which have previously been considered as being suitable only for use as road fill are known to contain substantial quantities of energy. However, it has not been previously possible to efficiently burn such materials without producing substantial pollution and without harm to the burner due to the production of unburned products of combustion which foul burner mechanisms. While certain presently available burners are being employed to burn these "lower grade" materials, the situation is not satisfactory due to the facts of increased pollution, hardware deterioration, and other operational problems.

While the present invention can be used for atomization of any fluid, it is particularly to be noted that the present structure is useful for atomization of a liquid fuel immediately prior to combustion in order to maximize combustion efficiency. In a basic sense, combustion is seen to be the rapid chemical combination of oxygen with the combustible elements of a fuel. The objective sought for in combustion processes is the release of all heat available in the fuel which is being burned. In order to obtain this objective, it is necessary to minimize losses from combustion imperfections and superfluous oxidizing medium. In practice, it is attempted to maximize combustion efficiency by the provision of sufficiently high temperatures for efficient ignition, the subjection of the fuel to efficient mixing with the oxidizing medium, and the provision of sufficient time to allow complete combustion between the fuel and the oxidizing medium. The most difficult of these factors to retain is the mixing of the fuel with the oxidizing medium in a manner sufficient to maximize combustion efficiency. A particular method which has been used to provide a more intimate contact between fuel and oxidizing medium is the atomization of liquid fuel into the smallest possible droplet form, thereby to decrease the time per unit volume for conversion from a liquid to a gaseous state. The fuel in the gaseous state is thus capable of more intimate mixing with the oxidizing medium.

High burning rates have previously been established with the injection of atomized fuel into regions of high turbulence and high shear. Atomization structures, such as that disclosed in U.S. Pat. No. 3,912,164, act to create regions of high turbulence and high shear by producing swirling air streams which produce regions of high turbulence and high shear at locations where the streams meet. According to this particular patent, relatively efficient atomization is caused by exposing a thin continuous sheet of fuel to high velocity air on both sides of the sheet of fuel.

Fuel atomization structures are also seen to be disclosed in U.S. Pat. No. 3,831,843. As is recognized in this patent, only a very small percentage of the total kinetic energy of the atomizing medium is typically imparted to the fuel. Since combustion intensity and efficiency is primarily determined by the average surface area of fuel particles in contact with oxidizing medium, the time required for the evaporation of liquid fuel droplets is critical when atomized fuel is being burned. Combustion efficiency is seen to increase with reduced fuel droplet size. However, no known prior art atomizing structure has been capable of producing efficient atomization of materials such as coal/oil slurries, asphalt and the like. An atomizing structure capable of producing fine particles of such materials would dramatically increase the availability of fuels for certain combustion applications. Further, such atomizing structure would more efficiently burn those fuels which are now used in these combustion applications. The present invention provides atomizing structure which is capable of efficiently burning previously unusable materials which have been used in applications such as roadbed fill since the means for utilizing the materials as fuel did not exist. The invention particularly subjects the fuel to contact with two separate flows of high velocity atomizing medium in order to efficiently emulsify and disperse the fuel prior to combustion.

SUMMARY OF THE INVENTION

The invention provides atomizing structure which contacts a fuel flow with two separate flows of high velocity atomizing medium in order to convert a liquid into a very fine fog or mist, thereby to greatly decrease the time required for conversion of the liquid into a gaseous state. The present structure efficiently emulsifies and disperses the fuel about the periphery of the structure, thereby allowing highly efficient combustion reactions to occur which are favorable to the burning of heavy distillate fuels at near stoichiometric fuel/oxidizer ratios with essentially no smoke or combustible residue. It is of particular note that the present structure is capable of burning mixtures of number 6 fuel oil and 200 mesh coal dust at efficiencies which allow the relatively pollution-free and effective use of such fuels.

The present invention particularly provides apparatus for efficiently atomizing conventional fuels and hertofore unusable liquid and slurry fuels to the degree that resulting micron fuel particles are positioned within an airstream such that minimum integral reactions are acquired for insuring maximum combustion efficiencies. The efficiency of the present apparatus allows the aforementioned unusable liquid fuels to be considered process fuels rather than roadbed fill material. Greater turndown is also possible as well as the selection of excess air rates for certain process requirements. The present apparatus permits operation between 3% to 5% excess air (0.6% to 1.0% excess oxygen) without smoke or combustibles. The burning of No. 2 fuel oil with the present atomizing structure results in a bright translucent flame similar to a natural gas flame. A No. 6 fuel oil flame is also bright and translucent when the oil is burned with the present atomizing structure. A coal/oil slurry flame is slightly brighter than a No. 6 flame. When the present structure is used, the level of noise during combustion is reduced, carbon formation on combustion chamber walls is eliminated, and no wear occurs on atomizer parts.

According to the invention, atomizing medium is directed at normally sonic velocities into contact with a plurality of fuel streams exiting from spaced ports on the atomizer head, the fuel stream impinging on the atomizing medium at right angles to the flow of the medium or tangentially as will be described hereinafter. Emulsification thus occurs between the atomizing medium and the fuel to cause fine liquid droplet formation and mixing. Downstream of the zone of contact between the fuel and the atomizing medium is a partially enclosed zone sized to reduce emulsion flow velocity to a lower level, thereby to permit additional contact time between the fuel and the atomizing medium in order to further enhance fuel droplet vaporization. The emulsion flow is then subjected on flow downstream of the zone to an angled stream of atomizing medium which acts as an impact area to cause the emulsion to disperse about the periphery of the atomizer. This second stream of atomizing medium redirects the flow of the emulsion to produce a desired flame front in a downstream combustion chamber. The angle of intercept of the second stream of atomizing medium and the velocity differential between the emulsion flow and said second atomizing medium stream causes the emulsion to be stripped across its flow diameter and to be laid down as a thin blanket on the upstream surface of the second atomizing medium stream. The thin emulsion blanket thus formed flows in a direction generally across the direction of combustion air flow. Combustion air required to maximize burner combustion efficiency is thus minimized.

It is therefore an object of the present invention to provide atomizing structure for efficiently atomizing both conventional fuels and heretofore unusable liquid fuels in order to produce micron-size fuel particles which are positioned within an oxidizing stream in a manner which requires minimum integral reactions and insures maximum combustion efficiencies.

It is another object of the invention to provide atomizing structure wherein two separate flows of atomizing medium sequentially contact a fuel flow in order to maximize fuel combustion efficiency.

It is also an object of the present invention to provide atomizing structure wherein a first flow of atomizing medium acts to emulsify a liquid fuel by aerodynamic shear and turbulence while a second flow of atomizing medium disperses and redirects the emulsion of atomizing medium and fuel formed by mixing of said first atomizing medium and fuel.

It is a still further object of the invention to provide atomizing structure wherein an emulsion of a first atomizing medium and liquid fuel contacts at an angle a second stream of atomizing medium moving at a greater velocity than said mixture, thereby stripping the emulsion mixture across the flow diameter thereof and laying down the emulsion mixture as a thin blanket on the upstream surface of the second atomizing medium stream, thereby to minimize the amount of combustion air required for maximization of burner combustion efficiency.

It is a further object of the invention to permit adjustment of the angle of secondary atomizing medium to provide for flame shaping, variation in required combustion air pressure, and to compensate for specific fuel weights and evaporation characteristics, the evaporation characteristics of the fuel being affected by the angle of fuel droplet path with combustion air path, due to the resultant relative velocities of the droplets and air.

It is a further object of the invention to permit adjustment of the angle of secondary atomizing medium to provide for control of degree of flue gas recirculation as may be required for operational compatibility of heater system (i.e., heat transfer zone such as heater or boiler tube surfaces) and some control over variation of $NO_x$ formation.

It is a further object of the invention to place fuel oil in direct initial contact with combustion air (i.e., air side rather than furnace side) to obtain good ignition qualities and assure flame stability. Also, in the case of steam as the atomizing medium, the majority of the steam will be downstream of the burning fuel (flame front) so that the affinity for steam to alternate an ultraviolet signal from an ultraviolet flame safety sensing device normally located upstream (combustion air side) of the flame front.

It is a further object of the invention to provide continuous annuli for fuel and primary atomizing medium passages (secondary atomizing medium passage is presently continuous annulus) for specific applications where more evenly distributed flame front is desired. In case of multiple ports, the resulting fuel pattern entering the flame front has alternate "thick" and "thin" fuel thicknesses, allowing for combustion air penetration at relatively low pressures. The continuous annuli would permit a thinner average fuel thickness, allowing more rapid and more efficient fuel burning, but requiring more pressure capability of the combustion air for penetration. Although the pressure capability would be approximately twice that for the multiple port arrangement, this thinner film of fuel is especially attractive for burning solid fuel particles such as coal in coal/oil slurries, since the solid particle is less likely to be surrounded by the oil (liquid) droplets, which must be vaporized and burned before the solid particles can be directly exposed to the combustion air for ignition.

Further objects and advantages of the invention will become more readily apparent in light of the following detailed description of the preferred embodiments of the invention.

DESCRIPTION OF THE PREFERRED EMBODIMENTS

Figure 1:
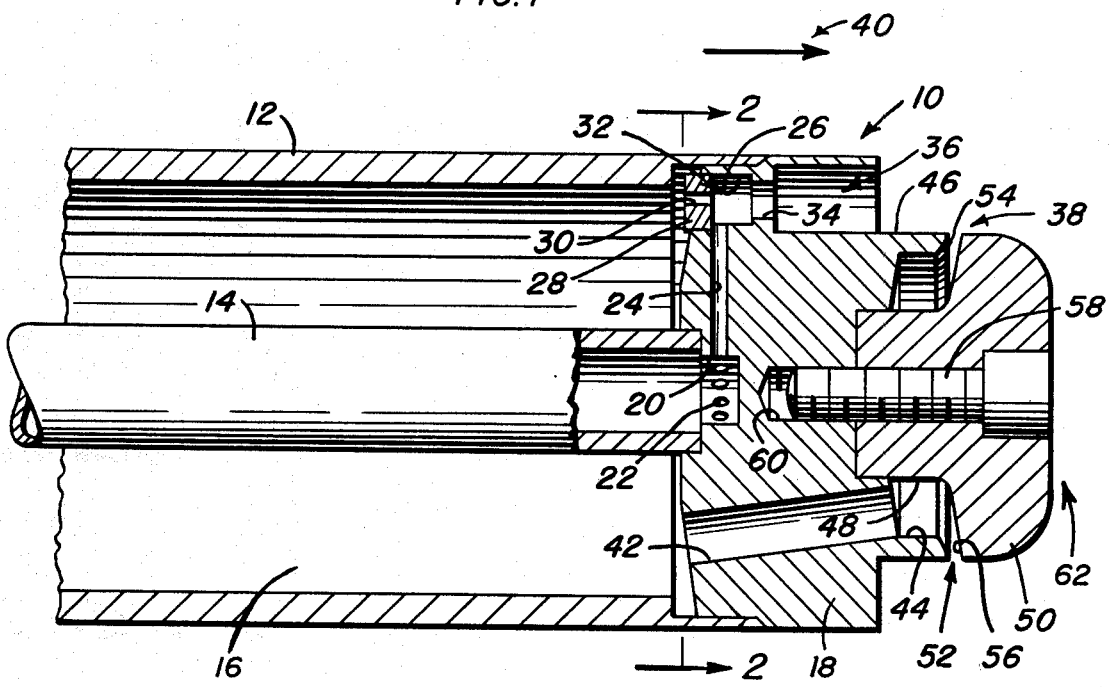
FIG. 1 is an elevational view in partial section of an atomization structure configured according to the teachings of the present invention.
Figure 2:
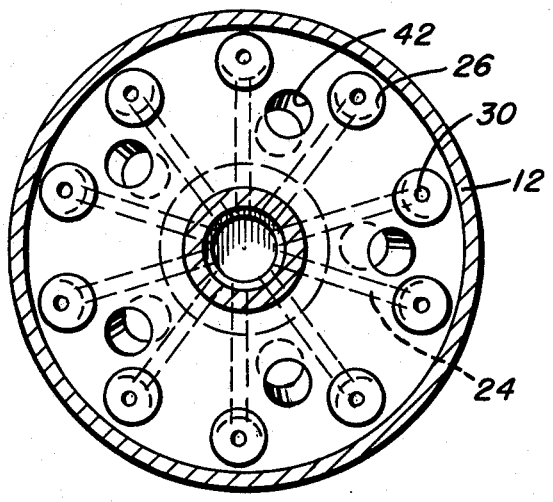
FIG. 2 is a section taken along lines 2—2 of FIG. 1.

Referring now to the drawings and particularly to FIGS. 1 and 2, apparatus configured according to the invention is seen to comprise an atomizer head shown generally at 10. The atomizer head 10 is connected at its anterior end to sources (not shown) of atomizing medium and fuel, the sources and a means for connecting the sources to the head 10 being well known in the art. Accordingly, the drawings will be simplified by omitting a showing of these well-known portions of a complete system. The atomizer head 10 is seen to be comprised of an outer casing 12 which takes the form of a cylindrical pipe member. The outer casing 12 has an inner conduit pipe 14 disposed interiorly of said casing and located centrally thereof. The interior of the outer casing 12 and the exterior surfaces of the inner conduit pipe 14 define a conduit or raceway 16 for the atomizing medium. The atomizing medium is thus seen to flow from a supply source through the outer casing 12 and into the body of the atomizer itself as will be described hereinafter. Similarly, liquid fuel is ducted from a supply source through the inner conduit pipe 14. The outer casing 12 is connected to atomizer body 18 such as by threads or other means of connection. It is preferable that the center lines of the outer casing 12 and inner conduit pipe 14 lie along the longitudinal axis of the atomizer head 10. The distal end of the inner conduit pipe 14 is suitably joined to the atomizer body 18 at the anterior end of said body 18 and centrally thereof. The conduit pipe 14 communicates with a fuel manifold chamber 20 formed in the atomizer body 18, the chamber 20 having a plurality of peripherally spaced and radially directed openings formed therein. Each of the openings 22 communicate with one radially extending fuel duct 24, which ducts 24 each extend into communication with a primary atomization port 26, the fuel ducts 24 entering the ports 26 substantially at right angles to the flow of atomizing medium through said ports 26 as will be described hereinafter. As is particularly seen in FIG. 2, the atomization ports 26 are spaced about the outer periphery of the atomizer body 18, preferably in a regular pattern.

The primary atomization ports 26 essentially comprise cylindrical chambers formed within the atomizer body 18 such as by drilling. The anterior end of the ports 26 receive circular flow regulating inserts 28, the inserts 28 having an appropriately sized metering orifice 30 formed centrally therein. One each of the inserts 28 are disposed in each port 26. The inserts 28 can be removed and replaced with inserts having orifices 30 of differing size in order to allow control of the atomizing medium which passes through the orifices 30 into the ports 26. As is particularly seen in FIG. 1, the inserts 28 are contacted by the atomizing medium in the raceway 16 and meter the flow of atomizing medium into the primary atomization ports 26. It is to be noted that the anterior end wall of the atomizer body 18 could be formed as a single surface having the metering orifices 30 drilled therein if it is not desired to provide for variation of the size of the metering orifices 30.

Accordingly, it is seen that fuel is distributed to the atomization ports 26 by means of the fuel ducts 24 which extend radially from the fuel manifold chamber 20 which receives fuel from the conduit pipe 14. It is also seen that atomizing medium enters the primary atomization port 26 through the associated metering orifice 30, the flow of the atomizing medium being essentially at right angles to the flow of the fuel entering said port 26 through the fuel duct 24. The flow of atomizing medium into the atomization port 26 is at high velocity, typically sonic velocity, the orifice 30 being sized to produce such velocities. As will be noted hereinafter, not all of the atomizing medium passes through the orifices 30 into the primary atomization ports 26, a portion of the atomizing medium passing through secondary passages formed in the atomizer body 18 as will be described hereinafter.

The primary atomization ports 26 are seen to be formed in the atomizer body 18 with the longitudinal axes thereof extending in the same direction as the flow of atomizing medium through the atomizer head 10. The ports 26 communicate with ambient through openings disposed at the distal end of the ports 26. As atomizing medium is discharged into the ports 26 through the orifices 30, the velocity of the atomizing medium causes downstream voids or low pressure regions 32 to exist in each of the ports 26 in the immediate vicinity of the orifice 30. The entry of the fuel duct 24 into the atomization port 26 is disposed in this region 32 in order to produce an ejector or educing action on the fuel in proportion to the mass flow rate of the atomizing medium. Therefore, the fuel is drawn through the fuel ducts 24 due at least in part to the educing action of the atomizing medium flow, the fuel then being mixed with the atomizing medium immediately downstream of the low pressure region 32. An annular restriction 34 may optionally be disposed essentially medially of the atomization port 26 in order to compress and reexpand the mixture of atomization medium and fuel which has formed on passage of the medium and fuel through the port 26. The restriction 34 simply comprises an annular ridge which locally reduces the interior diameter of the port 26. Use of the annular restriction 34 acts to provide a higher degree of emulsification of the fuel and atomizing medium. The degree of emulsification, or liquid droplet breakup and mixing, of the fuel and atomizing medium is also dependent on the vapor pressure of the liquid fuel and the resulting partial pressures of the liquid fuel and of the atomizing medium.

In a practical device, steam is typically utilized as the atomizing medium, a given steam pressure being caused to exist in the raceway 16 in a known manner. A typical steam pressure is approximately 100 psi, it being possible to utilize both lower and higher pressures in the present structure. The fuel pressure existing within the inner conduit pipe 14 is partially controlled by the eductor action of the atomizing medium as has been noted, the fuel pressure also being dependent upon parameters which include the pressure of the atomizing medium, fuel viscosity and structural features of the device. The pressure of the fuel is typically as high as 110 psi and as low as 0.

Figure 3:
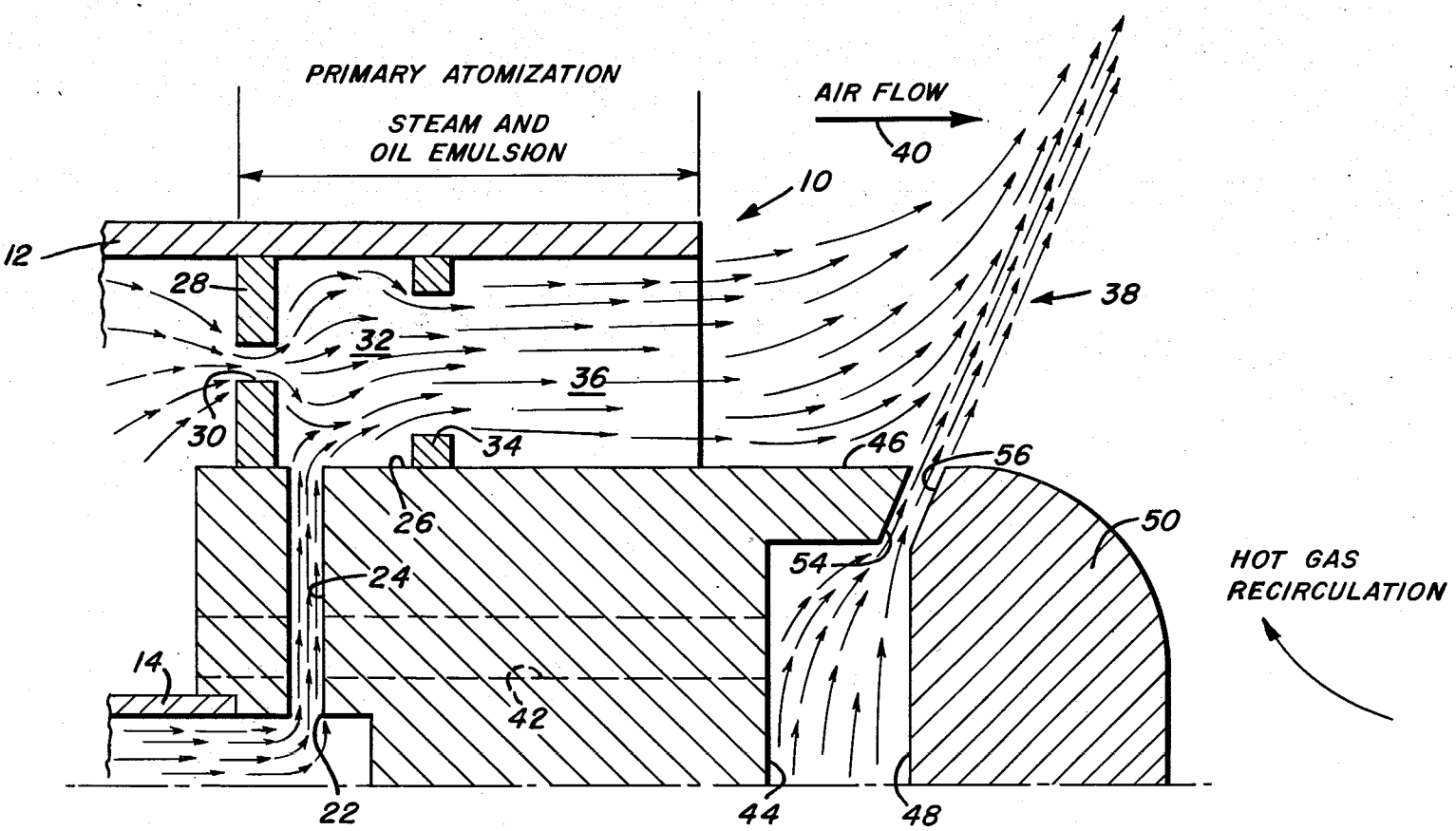
FIG. 3 is a detailed sectional view schematically presented illustrating the flow of atomizing medium and liquid through a portion of the present structure.

Referring particularly now to FIG. 3, it is seen that fuel immediately downstream of the low pressure region 32 is subjected to maximum aerodynamic shear forces by the sonic velocity of the atomizing medium. A boundary layer exists at this point in the portion of the atomizing medium that is at sonic velocity. However, this boundary layer is reduced as the sonic flow shocks down to subsonic velocity and exhibits extreme turbulence. Therefore, the atomizing medium and fuel are intimately mixed with the fuel being atomized into micron-size particles which are efficiently burned.

As again seen in FIG. 3, a velocity reduction zone of the port 26 is seen at 36 to be located downstream of the restriction 34, that is, near the exit of the material flow from the port 26. The length of the zone 36 is sized in order to reduce the flow velocity of the emulsified mixture of atomizing medium and fuel to a subsonic level, typically 300 to 400 feet per second. Further, the mixture of fuel and atomizing medium is permitted additional contact time within the velocity reduction zone 36 in order to further enhance fuel droplet vaporization. On exit from the ports 26, the streams of emulsified mixture of atomizing medium and fuel travel generally in the same direction of, or concurrent with, the center line of the atomizer body 18, that is, toward the location of a burner flame front and combustion chamber (not shown) such as would exist in an operational situation. Downstream of the ports 26, the streams of intimately mixed fuel and atomizing medium are subjected to an annular outwardly directed stream of atomizing medium in a secondary atomization zone disposed in an annulus at 38 about the periphery of the distal end of the atomizer body 18. This secondary flow of atomizing medium contacts the emulsified mixture at a desired angle, the secondary flow of atomizing medium being also directed radially across the path of the lower velocity emulsified mixture, a momentum exchange occurring due to this contact with the high velocity secondary atomizing medium. The higher velocity flow of atomizing medium within the secondary atomization zone 38 acts as an impact area to cause the emulsified mixture to begin spreading about the periphery of the atomizer body 18, thereby forming a peripheral dispersion of fuel and atomizing medium. The higher velocity of the secondary flow of atomizing medium within the zone 38 also acts to redirect the flow of the mixture in line with a desired flame front which is to be produced in the combustion chamber (not shown). Since this redirection is radial to the atomizer body 18, the emulsified mixture is further "thinned out" in proportion to the radial distance from the center line of the atomizer body 18. Due to the fact that this secondary flow of atomization medium intercepts the emulsified mixture at an angle and at a velocity differential, the mixture is further "stripped" across its flow diameter and laid down as a thin blanket on the upstream surface of the flow of secondary atomizing medium. This thin blanket of emulsion is further thinned as it is redirected radially. The emulsion blanket of fuel and atomizing medium is then seen to flow in a direction which is generally across the direction of the combustion air flow as seen at 40, thereby minimizing the amount of combustion air required to maximize burner combustion efficiency due to maximization of the probability of association of fuel molecules with oxygen molecules.

When using No. 6 fuel oil and a forced draft arrangement such as can be configured according to the several embodiments of the invention, the secondary atomizing medium angle is preferably taken to be 15 degrees forward, that is, 75 degrees from the burner center line. Such a forward pitch angle of 15 degrees of the secondary atomizing medium is seen to provide greatest advantage when used in a forced draft burner which incorporates a combustion chamber and particularly for fuel oils through No. 6 and for coal/oil slurries. A natural draft burner such as would be configured according to the present invention requires a forward pitch angle of between 20 and 30 degrees so that combustion air will be induced into the flame front as a result of greater forward momentum of the fuel and atomizing medium. As an example, an increase in the secondary atomizing medium forward pitch from a value of 15° to a value of 30° will correspondingly decrease the amount of flue gas recirculation due to lessening of the inherent low pressure region at the downstream surface of the atomizer tip. Accordingly, hot gas circulation paths in a heat transfer zone may be somewhat controlled as may be dictated by particular heat transfer surface arrangements. It is known that the degree of flue gas recirculation also effects $NO_x$ formation. Generally, higher flue gas recirculation results in lower $NO_x$ formation in combustion products.

Referring back again to FIGS. 1 and 2, the structure which produces the secondary flow of atomizing medium within the secondary atomization zone 38 is readily seen. Secondary supply ducts 42 are seen to be formed at regular intervals in the atomizer body 18, the anterior ends of the ducts 42 communicating with the interior of the outer casing 12, atomizing medium thus flowing into the ducts 42 at the anterior ends thereof and being discharged from the ducts 42 at the distal ends thereof. The ducts 42 are seen to be located inwardly within the atomizer body 18 of the primary atomization ports 26, these passageways being located and drilled into the atomizer body 18 in a manner such that no intercommunication exists. The secondary supply ducts 42 carry atomizing medium into an annular secondary manifold 44 formed by annular flange 46 formed on the distal end of the atomizer body 18 and surfaces 48 of atomizer afterbody 50. A secondary flow annulus 52 is thus created between the respective peripheries of the flange 46 and the atomizer afterbody 50 which define the secondary flow annulus 52. The annular secondary stream of atomizing medium thus flows from the secondary manifold 44 through the secondary flow annulus 52 and into contact with the emulsified mixture of atomizing medium and fuel as described above. Annular surfaces 54 and 56 respectively of the annular flange 46 and atomizer afterbody 50 are seen to be substantially parallel and extend at an angle to the general direction of flow of material through the atomizer body 18. Therefore, a secondary stream of atomizing medium exits the atomizer body at an angle to the flow of the emulsified mixture of atomizing medium and fuel which is formed in the primary atomization ports 26. Varying discharge angles can be utilized in order to produce a particular flame shape or to allow regulation of burner operating characteristics as desired. A forward pitch angle of 15° (75° to atomizer center line) has been found to be particularly useful for typical burner situations. It is further to be noted that the secondary flow annulus 52 can be varied in size in order to control the velocity at which the secondary stream of atomizing medium is discharged from the secondary flow annulus 52. In particular, a threaded bolt 58 which holds the atomizer afterbody 50 to the atomizer body 18 has its anterior end received within a threaded channel 60 formed centrally of the atomizer body 18. By causing the atomizer afterbody 50 to move with the threaded bolt 58 on regulation of the depth of insertion of said bolt 58 into the threaded channel 60, the size of the secondary flow annulus 52 can be controlled as desired. It is further to be noted that the secondary flow annulus 52 is sized in order to produce a normally sonic velocity of the secondary stream of atomizing medium in the secondary atomization zone 38.

In the burner environment, at least a portion of the products of combustion recirculate on the downstream side of the atomizer head 10 in the hot gas recirculation region shown generally at 62, this hot gas recirculation occurring due to the low pressure which exists in the region 62 in the downstream vicinity of the afterbody 50. This recirculation of combusted hot gas lends pressure stability to the secondary stream of atomization medium in the secondary atomization zone 38, thereby preventing undesirable deflection which might otherwise be caused by the impact between the emulsified mixture of fuel and atomization medium flowing from the primary atomization ports 26 into contact with the secondary stream of atomizing medium in the secondary atomization zone 38. Further, the hot gases within the recirculation region 62 act to transfer thermal energy to the fuel particles thereby further enhancing vaporization of the fuel particles.

Figure 4:
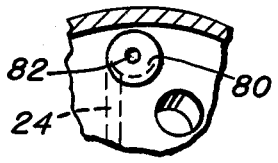
FIG. 4 is a detailed sectional view schematically illustrating the tangential supply of steam to an emulsification port according to an alternative embodiment of the invention.

Referring to FIG. 4, a schematic view is seen which shows steam flow to enter tangentially into emulsification or atomization port 80, which port 80 is essentially equivalent to the port 26 shown in FIG. 1. As configured in FIG. 4, fuel is seen to enter into the port 80 through orifice 82 in a direction parallel to the center line of the burner structure. In this embodiment, the atomization medium, which is taken here to be steam, enters port 80 through duct 24. The duct 24 is seen to be displaced to the side of the port 80 in a substantially tangential arrangement such that the atomizing medium entering the port 80 causes a vortex in the center of said port. This tangential entry and resulting vortex pulls fuel in through the orifice 82 and disperses the fuel radially into the atomizing mixture. It is to be noted that larger particles can also be pulled into the port 80 by this vortex arrangement. The resulting mixture of atomizing medium and fuel then exits the port 80 in a helical or corkscrew pattern. It is therefore to be seen that the mixture of fuel and atomizing medium, regardless of which of these two materials flows parallel to the center line of the burner, can occur tangentially or as shown in FIGS. 1 and 2. The embodiment of FIG. 4 also illustrates the fact that the relative flow paths of the fuel and atomizing medium may be switched in the several embodiments of the invention.

The present structure is seen to be particularly resistant to wear since only the high velocity flow areas existing in the metering orifices 30 and over the annular surfaces 54 and 56 are subjected to mass flows which would produce wear. Proper selection of sufficiently hard materials for the surfaces would reduce these wear problems. Further, since the flow regulating inserts 30 can be replaced, maintenance is readily effected at this location. Additionally, the size of the secondary flow annulus 52 can be adjusted as aforesaid in order to compensate for gap changes caused by wear in the annulus 52. Structures formed according to the present teachings have previously been formed of carbon steel with no signs of wear being present throughout the lengthy testing which has to date occurred.

While the present structure has been described as utilizing a single atomizing medium which is channeled into two separate portions of the atomizer body 18 for sequential contact with fuel which is to be atomized, it is to be understood that separate atomizing media can be employed and that the supply sources for these media could be separate whether the media were indeed different or the same material. It is believed apparent from the foregoing disclosure that the atomizer body 18 could be configured other than as particularly described hereinabove, the present disclosure providing sufficient teachings which would enable one of ordinary skill in the art to modify the present structure without departing from the scope of the invention. Accordingly, in order to secure the scope of protection warranted by the foregoing teachings, it is to be understood that the scope of protection for the invention is to be defined only by the recitations of the appended claims.

What is claimed is:

1. In apparatus for atomizing a fluid fuel; an atomizer body having an inlet end, a distal outlet end, and a longitudinal axis extending between said ends, a chamber defined in said body through the inlet end thereof, at least one primary atomization port at the periphery of the body, said port generally paralleling the body and including inlet and outlet ends, a fluid passage communicating said chamber with said port between the inlet and outlet ends thereof, first means for supplying fluid fuel, second means for providing a primary flow of atomizing medium under pressure, one of said supplying means communicating with said port at the inlet end thereof, the other of said supplying means communicating with said port through said chamber and said fluid passage for an introduction, mixing and atomizing of the fluid fuel with the atomizing medium within the port and a subsequent pressurized discharge flow of atomized fuel from said port at the outlet end in a direction generally paralleling the longitudinal axis of said body, and means for introducing a secondary direction defining flow of atomizing medium laterally outward into the path of the discharge flow of atomized fuel at a greater velocity than that of the discharge flow to effect a laterally outward spreading of the atomized fuel relative to the body, and a thinning of the atomized fuel in a layer on the upstream surface of the secondary flow.

2. The apparatus of claim 1 wherein the means for introducing a secondary flow of atomizing medium includes an outer chamber defined in said body toward the outlet end thereof and a flow path extending from the outer chamber and laterally directed relative to path of the discharge flow forward of the outlet end of the port.

3. The apparatus of claim 2 wherein said means for providing a primary flow of atomizing medium includes a conduit communicating with the inlet end of said port, the means for introducing a secondary flow further including a duct remote from said port and communicating said conduit with the outer chamber whereby said primary and secondary flows of atomizing medium can originate from a common source.

4. The apparatus of claim 3 wherein multiple duplicate atomization ports are provided about the periphery of said body, said first mentioned chamber being in the nature of a manifold with fluid passages communicating with each of said multiple ports, said conduit communicating with all of said ports for a simultaneous introduction of a primary flow of atomizing medium therein.

5. The apparatus of claim 1 wherein the angle of incidence of the secondary flow of atomizing medium is a 15° forward pitch angle.

6. The apparatus of claim 1 wherein the primary atomization port is formed as an extended channel with the lengthwise dimension thereof directed along the longitudinal axis of the atomizer body, the channel being extended for a finite distance downstream of the zone of initial introduction and mixing between the atomizing medium and fluid fuel to define a velocity reduction zone wherein the velocity of the mixture of atomizing medium and fluid fuel is reduced prior to exit of the mixture from the primary atomization port.

7. The apparatus of claim 6 and further comprising annular restriction means disposed interiorly of the primary atomization port downstream of the zone of initial introduction and mixing between the atomizing medium and fluid fuel for compressing and re-expanding the mixture to provide a higher degree of emulsification of the mixture.

* * * * *